US009856703B2

(12) United States Patent
Taraldrud et al.

(10) Patent No.: US 9,856,703 B2
(45) Date of Patent: Jan. 2, 2018

(54) DRILLING RIG ARRANGEMENT

(71) Applicant: Castor Drilling Solution AS, Kristiansand S (NO)

(72) Inventors: Paal Anders Taraldrud, Tveit (NO); Øyvind Vaagland Reiten, Lillesand (NO)

(73) Assignee: Castor Drilling Solution AS, Kristiansand S (NO)

( * ) Notice: Subject to any disclaimer, the term of this patent is extended or adjusted under 35 U.S.C. 154(b) by 0 days.

(21) Appl. No.: 14/901,886

(22) PCT Filed: May 5, 2014

(86) PCT No.: PCT/EP2014/059061
§ 371 (c)(1),
(2) Date: Dec. 29, 2015

(87) PCT Pub. No.: WO2015/007412
PCT Pub. Date: Jan. 22, 2015

(65) Prior Publication Data

US 2016/0376848 A1 Dec. 29, 2016

(30) Foreign Application Priority Data

Jul. 16, 2013 (NO) ..... 20130991
Jul. 16, 2013 (NO) ..... 20130992

(51) Int. Cl.
*E21B 15/02* (2006.01)
*E21B 19/09* (2006.01)

(52) U.S. Cl.
CPC ..... *E21B 15/02* (2013.01); *E21B 19/09* (2013.01)

(58) Field of Classification Search
CPC ..... E21B 15/02; E21B 19/09
See application file for complete search history.

(56) References Cited

U.S. PATENT DOCUMENTS 2,539,695 A * 1/1951 Moon ..... E02B 17/027 405/204
3,259,371 A * 7/1966 Goepfert ..... B63B 35/4413 254/270

(Continued)

FOREIGN PATENT DOCUMENTS

NO 20100955 A 1/2012
WO WO-2004067435 A1 8/2004

(Continued)

OTHER PUBLICATIONS

Simunec, Duro, "International Search Report," prepared for PCT/EP2014/059061, dated Apr. 22, 2015, seven pages.

*Primary Examiner* — Matthew R Buck
*Assistant Examiner* — Aaron L Lembo
(74) *Attorney, Agent, or Firm* — Winstead PC

(57) ABSTRACT

The invention provides a system for operating a drilling rig on a drilling vessel, the system comprising a drilling tower (2) having at least two segments (4, 5), a first segment (4) is fixedly connected to the drilling vessel (1), a second segment (5) is connected to the first segment (4), said second segment (5) is adapted to move longitudinally relative the first segment (4) by raising and lowering means. A tool (8) is suspended from at least one wire (16), said at least one wire (16) is extending over at least one sheave (7*a*, 7*b*) on top of the second segment (5), said at least one wire (16) is coupled to with a passive compensator arrangement (20) and a winch (14), said passive compensator (20) is connected to the winch (14).

13 Claims, 17 Drawing Sheets

(56) References Cited

U.S. PATENT DOCUMENTS

| | | | | |
|---|---|---|---|---|
| 3,502,143 | A * | 3/1970 | Petersen | E21B 7/128 166/355 |
| 3,834,672 | A * | 9/1974 | Hawley | B66D 1/48 254/392 |
| 4,134,237 | A | 1/1979 | Armstrong | |
| 4,428,421 | A * | 1/1984 | Rankin | E21B 19/02 166/385 |
| 6,000,480 | A * | 12/1999 | Eik | E21B 19/008 166/350 |
| 6,595,494 | B1 | 7/2003 | Roodenburg et al. | |
| 7,530,399 | B2 * | 5/2009 | Dreelan | E21B 19/008 166/352 |
| 8,770,272 | B2 * | 7/2014 | Harrell | B66D 1/44 166/77.1 |
| 9,284,797 | B2 * | 3/2016 | Skinnes | E21B 19/006 |
| 2003/0172599 | A1 | 9/2003 | Frink | |
| 2005/0077049 | A1 | 4/2005 | Moe et al. | |
| 2009/0133881 | A1 | 5/2009 | Roodenburg et al. | |
| 2012/0291684 | A1 | 11/2012 | Humphreys | |

FOREIGN PATENT DOCUMENTS

| | | | |
|---|---|---|---|
| WO | WO-2006105764 | A1 | 10/2006 |
| WO | WO-2014209131 | A1 | 12/2014 |

* cited by examiner 20
63
62C
58
62A
62B

DRILLING RIG ARRANGEMENT

FIELD OF THE INVENTION

The present invention relates to an arrangement for a drilling rig that serves as a supporting tower structure for lifting and supporting drilling machines and other tools. More particularly the invention relates to a retractable drilling rig with a passive heave compensation system and a winch system arranged in connection with the drilling rig.

BACKGROUND OF THE INVENTION AND PRIOR ART

Drilling ships and semi-submersible platforms are equipped with drilling rigs to support the necessary lifting of equipment under various offshore operations. Usually, these derricks are equipped with passive and active compensator systems to compensate for relative movements between the vessel and the seabed due to vessel wave impact.

The wave compensation systems are designed for handling of maximum loads at the seabed or down hole. This is often accomplished by installing a passive compensator in the top of the drilling rig. This passive compensator compensates the weight hanging on the crown block relative to the movement between the vessel and the seabed by means of a cylinder system of a pre-charged accumulator. Other systems are compensated by active draw-works/winches without any passive/autonomous compensator systems.

The traditional draw-work system lifts also only include one single wire that is led through many discs to achieve the correct ratio between the crown block and the lift block. This could result in challenges related to security, the lifetime of the cable, and noises due to the high speed of the cable and in the winch system.

The passive compensation system in the top of drilling rig is heavy and not easily accessible for maintenance. Considerable weight in the top of the derrick is detrimental to the properties of the vessel. They also have a large cylinder area adapted to the need to compensate passively for maximum load at ultra deep water operations. This large cylinder area results in large load variations at small loads at shallower waters and easier well intervention operations. In case of an active draw-work-configuration, the rig has no back-up in case of possible loss of electrical power supply and is therefore less suitable for critical operations.

The drilling rigs (derricks) consist traditionally of a pyramidal steel framework with square or rectangular cross-section assembled together to a fixed structure. The drilling rigs have a complex structure. They comprise multiple parts that may lead to high risk of falling objects. The height of the rigs is fixed without any possibilities to change the height when the drilling rigs are mounted together. This makes the maintenance work on top of the drilling rig more difficult.

Ice formation on the framework of the drilling rigs is another challenge of drilling rigs according to prior art. This is especially a problem when operating in arctic environments.

SUMMARY OF THE INVENTION

The invention provides a system for operating a drilling rig on a drilling vessel. The system is distinctive in that the system comprises a drilling tower having at least two segments, a first segment is fixedly connected to the drilling vessel, a second segment is connected to the first segment, said second segment is adapted to move longitudinally relative the first segment by raising and lowering means, a tool is suspended from at least one wire, said at least one wire is extending over at least one sheave on top of the second segment, said at least one wire is coupled to with a passive compensator arrangement and a winch, said passive compensator is connected to the winch.

Preferable embodiments of the system are defined in the dependent claims 2-12.

The invention also provides a heave compensation arrangement adapted to passively compensate a drilling tool suspended on at least one wire extending over at least one sheave on the top of a drilling tower. The heave compensation system is distinctive in that the compensation arrangement comprises at least one compensation sheave, wherein said at least one wire is extending over said sheave and to said winch, a dampening device is arranged operatively between the at least one compensator sheave and the winch, said dampening device having a plurality of compensator cylinders adapted to compensate different loads.

Preferable embodiments of the heave compensation arrangement are defined in the dependent claims 14-16.

The invention also provides a winch system. The winch system is distinctive in that the system includes a plurality of hydraulic motors adapted to be selectively engaged with a common winch drum.

Preferable embodiments of the winch system are defined in the dependent claims 18-20.

The present invention relates to a development of a cost and energy efficient concept for a drilling and intervention tower with accompanying elevator/draw-work system that is flexible with a focus on increased security. The system is also easier in terms of fabrication, installation and maintenance. Central to this technology development is more suitability for operations in arctic waters. It is also more adaptable to different types and sizes of vessels and platforms. The concept includes a cylindrical tower/mast construction with wire sheaves at the top to support a balanced lifting of the travelling assembly. The tower is telescopic (ie., it could be lowered and raised) and has a flanged fastening point towards the drilling floor structure. The tower/mast comprises at least two segments that allow the upper segment of the tower to be lifted and lowered in the lower segment by means of typical internal toothed rod drives to reduce a building and sailing height. At the top of the drilling rig, there are mounted lifting sheaves where the lifting wires are guided above.

Lifting and compensating for the top drive or drilling tool and landing of pipe segments to the seabed is carried out by means of a combined/integrated winch and a heave compensator located at or possibly below the drill floor level. The system typically includes a winch with one wire drum that typically operates six separate lifting wires connected to the same drive shaft, each of these wires is typically led through a 2:1 gear compensation system as an integrated part of the hoisting apparatus. Hence, a combined unit for lifting and active and autonomous-passive heave compensation is achieved. The winch system could have several digital driving units that allow optimal transmission and possibilities for active heave compensation. Typically, six cylindrical compensators (jiggerwinch) are connected to a controllable pre-charged volume of gas which contributes to an almost constant balanced load in a heave motion relatively restricted by the wave motion and associated by the stroke length of the cylinders. To achieve the best compensation performance, of this minimum load variation, with small loads in the wires, one or more of the compensation cylinders could be unloaded. This could be performed either hydraulically and/or mechanically (in standby position), so that the load is transferred and compensated by the necessary number of compensation cylinders, which are optimal related to compensation load. This is, on the other hand, optimal to avoid large friction and dynamically load variations.

The present invention is considered to have the following advantages over prior art:

Optimized hydraulic drive and heave compensation system that reduces power requirements and hence lower greenhouse gas emissions.

Reduced height of the vessel when sailing to increase the stability of the vessel and obtain less air resistance when the ship is in transit. The reduced height makes it easier to pass under bridges, which opens access, for instance, to the Caspian Sea as well as other places/waters where reduced sailing height is a critical factor and also give possible access by rig cranes to all area of tower and drill floor.

Great potential for weight savings because of cylindrical tower segments used in balanced lifting operation in comparison to a traditional framework drilling rig. Components of the system are smaller and thus allow for easier handling of parts.

Significantly lower center of gravity that allows larger deck load and improving sea qualities on the drilling vessel.

A low pipe setback results in a lower center of gravity and the possibility of the ship of making transit with a full setback.

Open drilling floor area provides significantly easier lifting and handling of pipes and other equipment on the rig floor area. It also gives the cranes full access to the entire rig floor. This feature also gives an excellent overview over all operations.

Less complex tower structure that increases the safety by greatly reducing the risk of falling objects.

Modular design that simplifies installation on board the vessel and reduces the risk of errors during installation.

By utilizing the production of a wind-turbine, the mast will provide major savings and potential for production efficiency compared to classic drills with derrickor draw works and top compensation arrangement.

Flexible drill concept that automatically adapts operations for all depths without influencing compensation characteristics.

The drilling rig arrangement has a larger operation window. The wind area of the tower structure is reduced.

Icing of structures can be easily prevented by heating the inside of the mast/tower. Surface area and therefore the heating area of the tower is reduced compared with a traditional derrick. This is an improvement since ice can accumulate on a traditional framework tower and cause hazardous falling objects.

Multiple lifting wires provides high redundancy and safety. This is a great improvement versus traditional drawwork systems where the crown block is suspended by only one single wire, hence the significant reduction in the risk of falling objects on the drill floor.

The drilling structure can be retracted and thus reduce the necessary height needed to access the top of the tower by deck cranes, which leads to easier maintenance and increased uptime of the overall drilling system. A wider range of shipbuilding locations could also be utilized. Shipyards with smaller crane capacity could also be used, and fewer shipyards would be obstructed by bridges.

The passive compensator is redundant with multiple cylinders to compensate the heave motion of the vessel.

Winch and compensator system can cooperate to achieve the optimally activated areas adapted to the winch load and the requirements of the compensator capacity.

The lifting winch uses multiple hydraulic motor winches, which give an excellent resolution.

There is excellent access for maintenance of all main components located at rig floor level.

The main objective of the present invention is to provide a drilling rig, which drilling rig is beneficial over the previous technology with respect to issues mentioned.

FIGURES

The invention will now be explained in detail with reference to the accompanying drawings, in which.

FIGS. 4*a*-4*b* and 5*a*-5*g* shows the guiderails attached to the tower segments in detail.

Figure 5B:
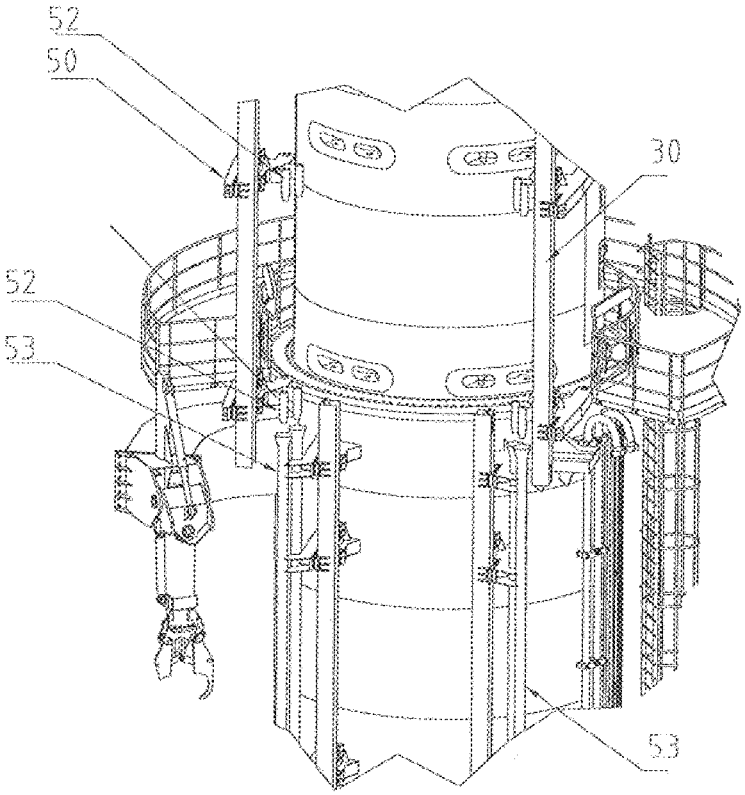
Figure 5A:
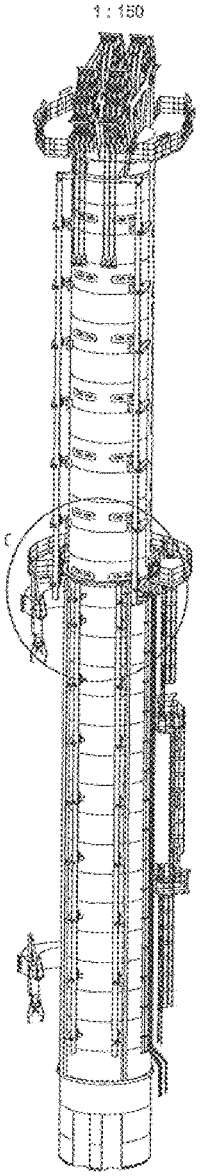
Figure 5C:
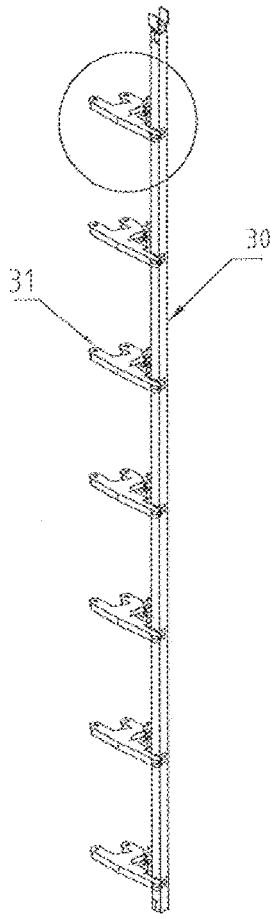
Figure 5D:
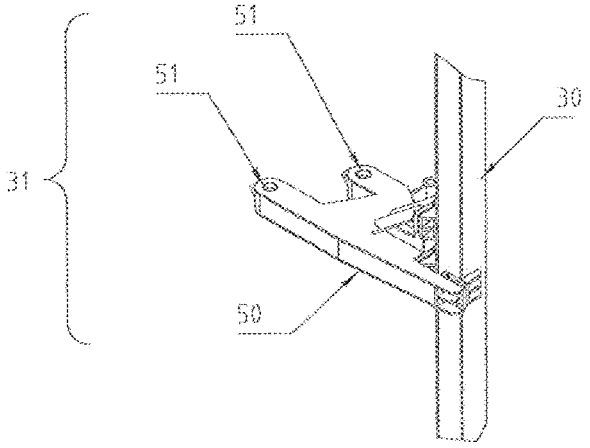
Figure 5F:
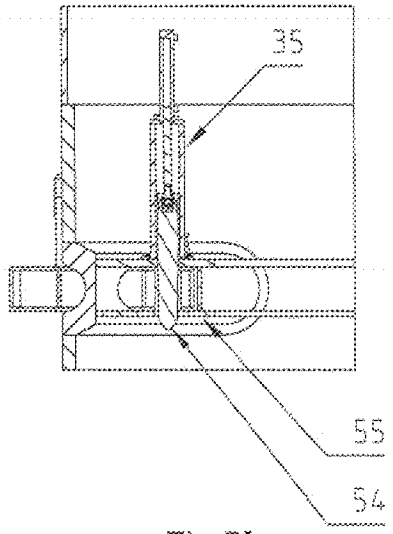
Figure 5E:
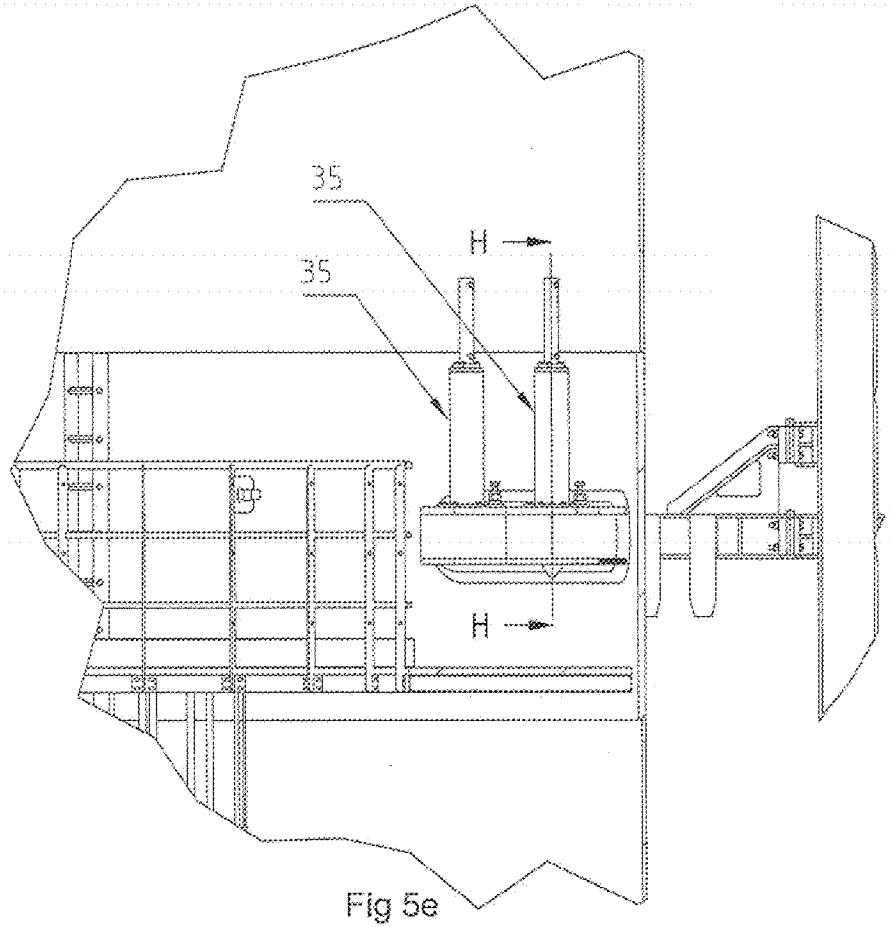
Figure 5G:
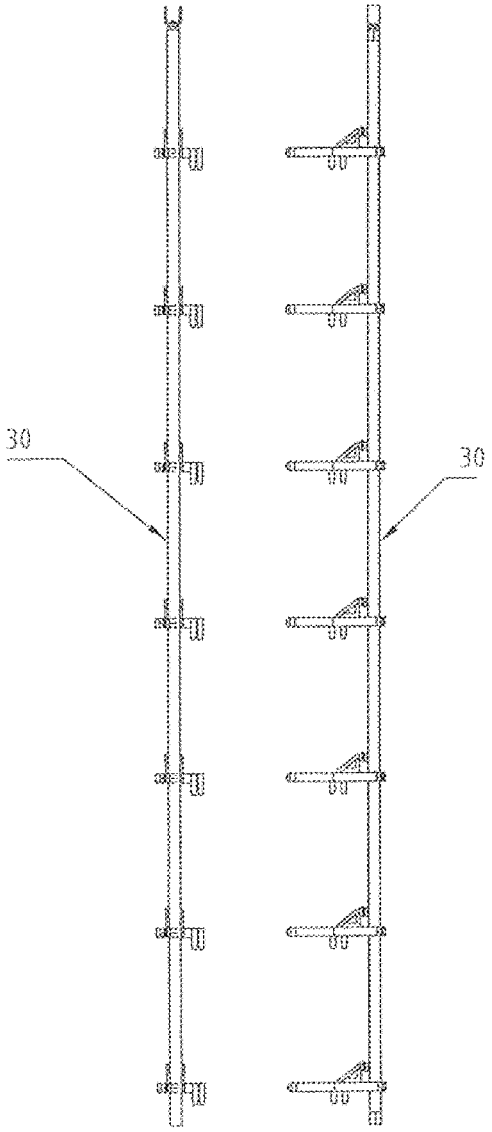
Figure 5I:
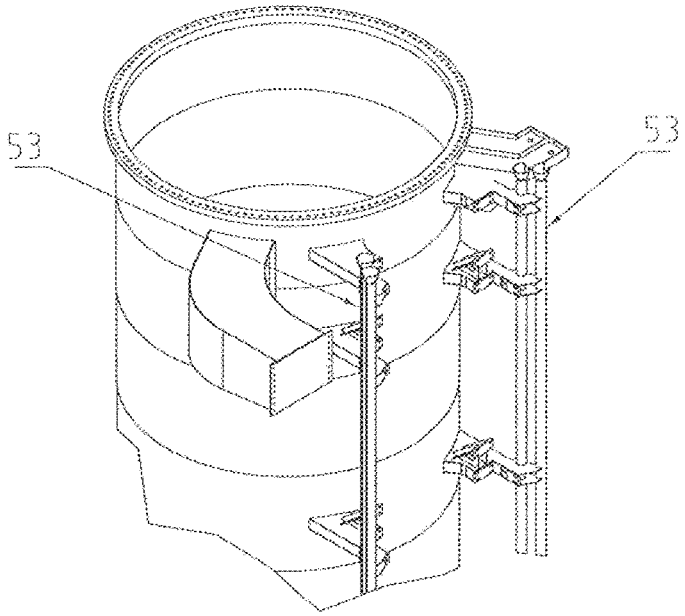
Figure 5H:
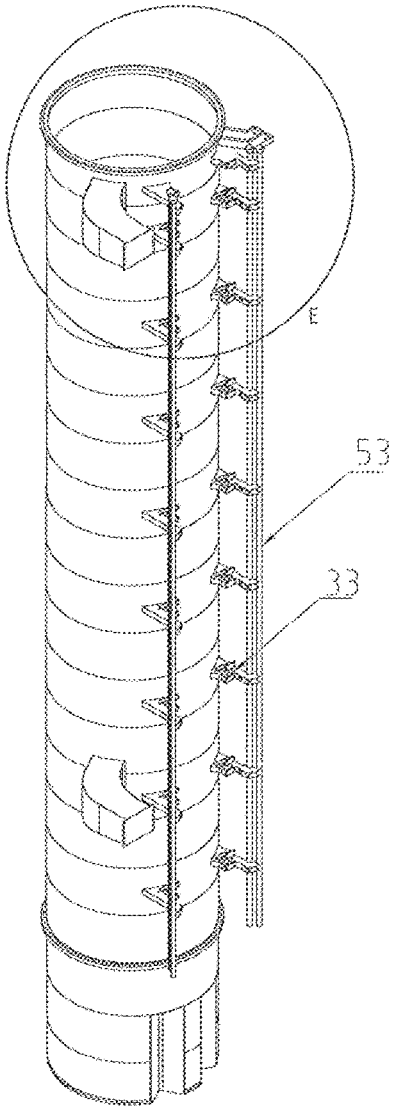

FIG. 5*h*-5*i* shows the first segment of the drilling tower and the guiderails attached to the first segment.

Figure 6:
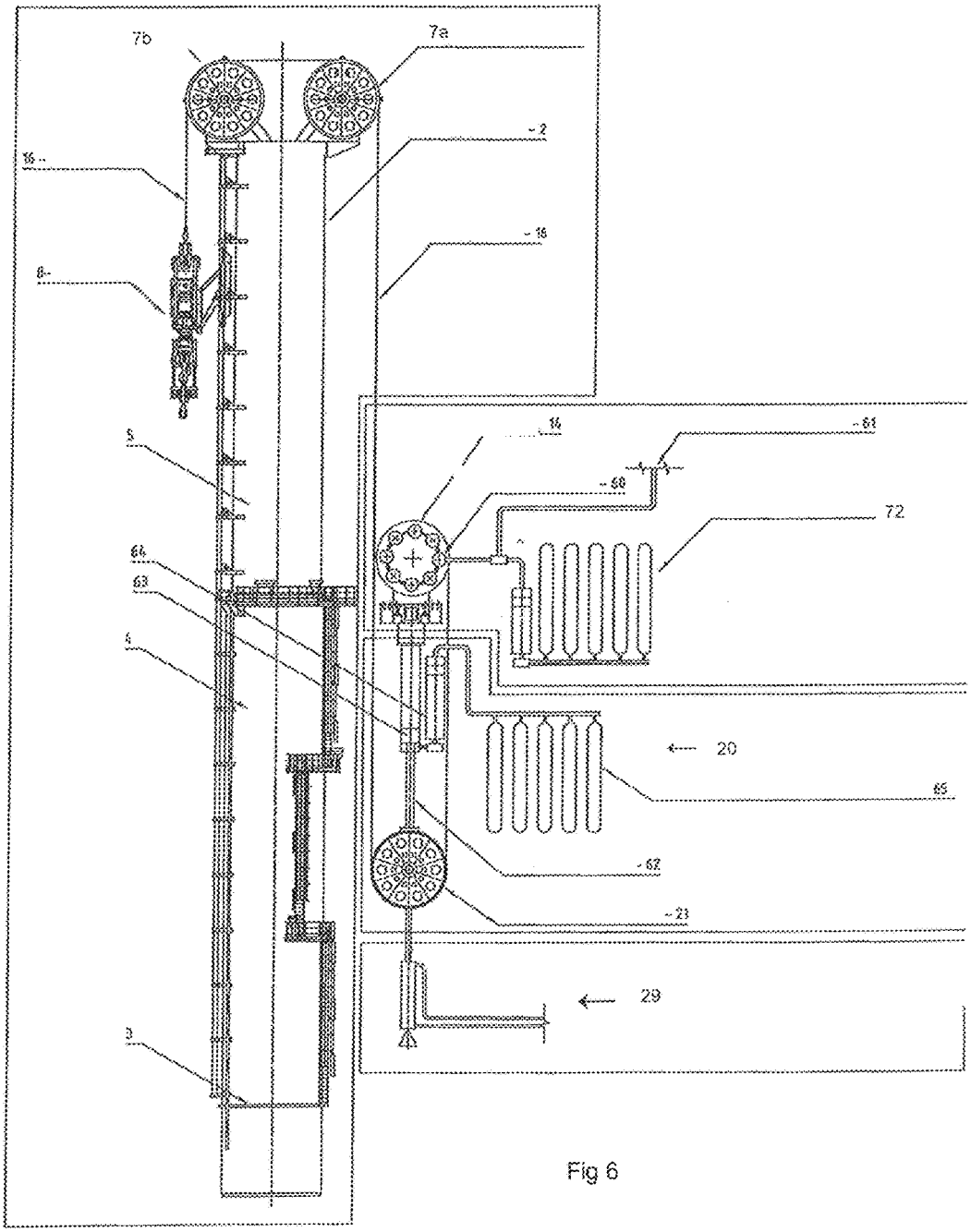

FIG. 6 is an overview of the drilling rig arrangement with the winch and heave compensation system according to the present invention. The winch and compensation system does not have the actual position relative to the drilling rig tower.

Figure 7B:
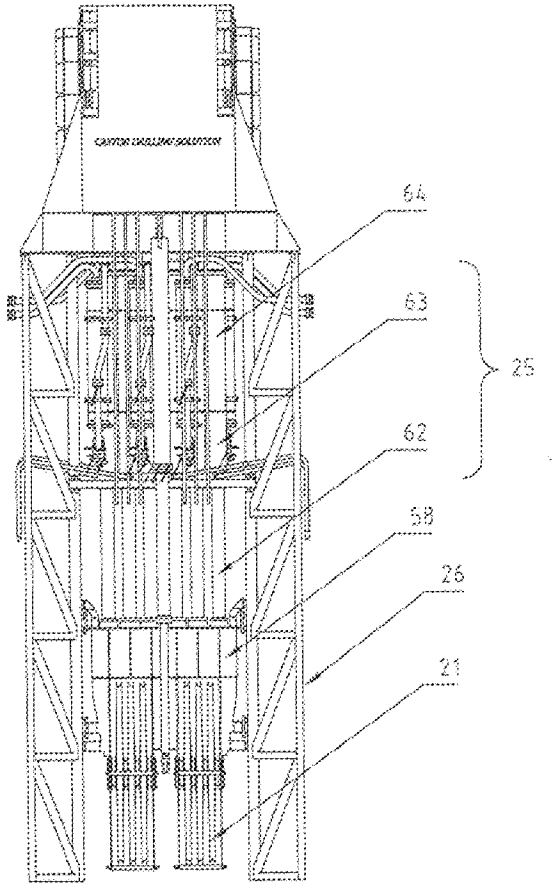
Figure 7A:
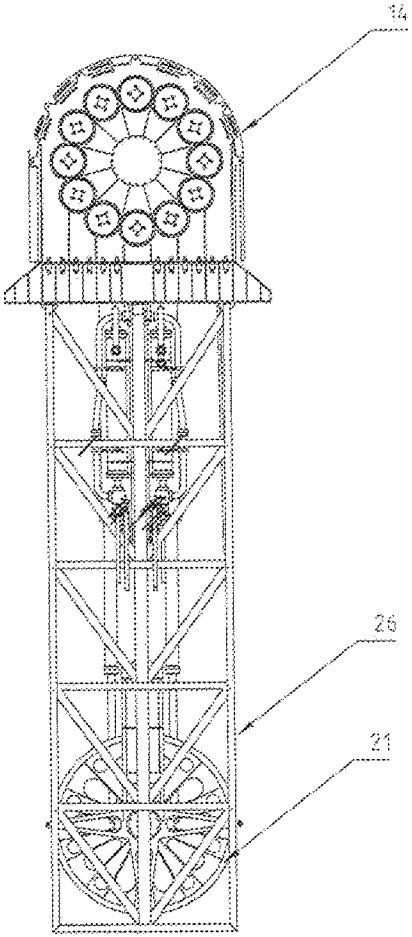

FIG. 7*a* shows the winch and compensator and winch system schematically, viewed from the side.

FIG. 7*b* shows the winch and compensator and winch system schematically, viewed from the behind.

Figures 8A, 8B, 8C:
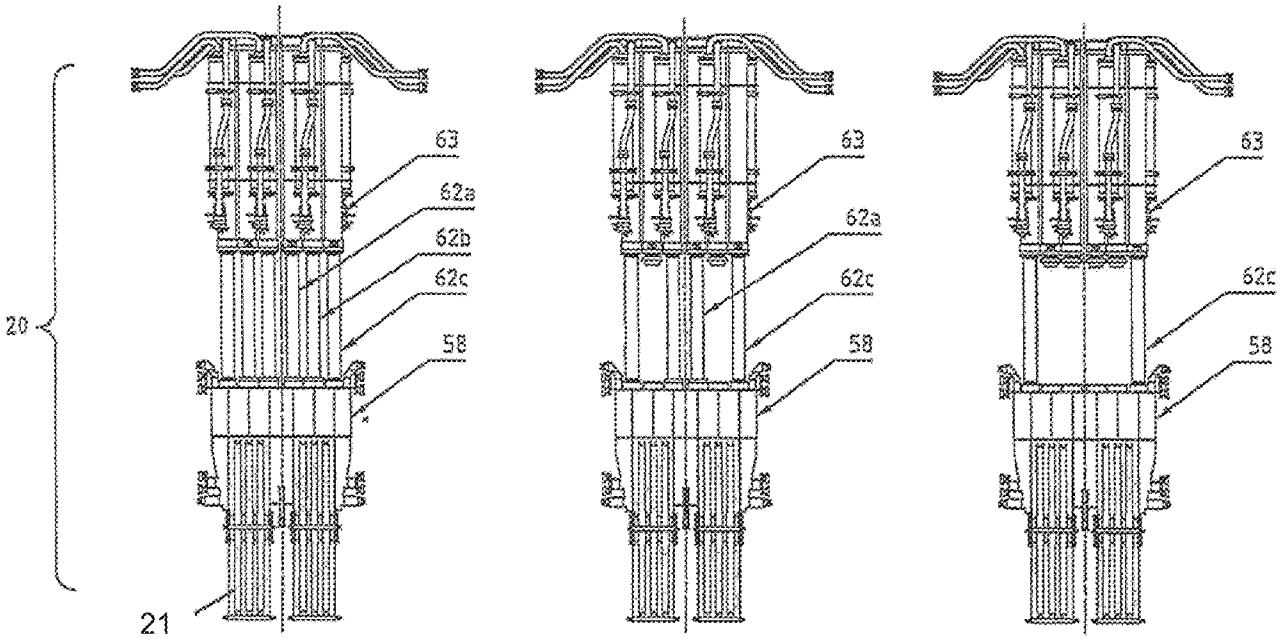

FIG. 8*a*-8*c* shows the passive heave compensation system with different compensator capacity.

Figures 9A, 9B, 9C:
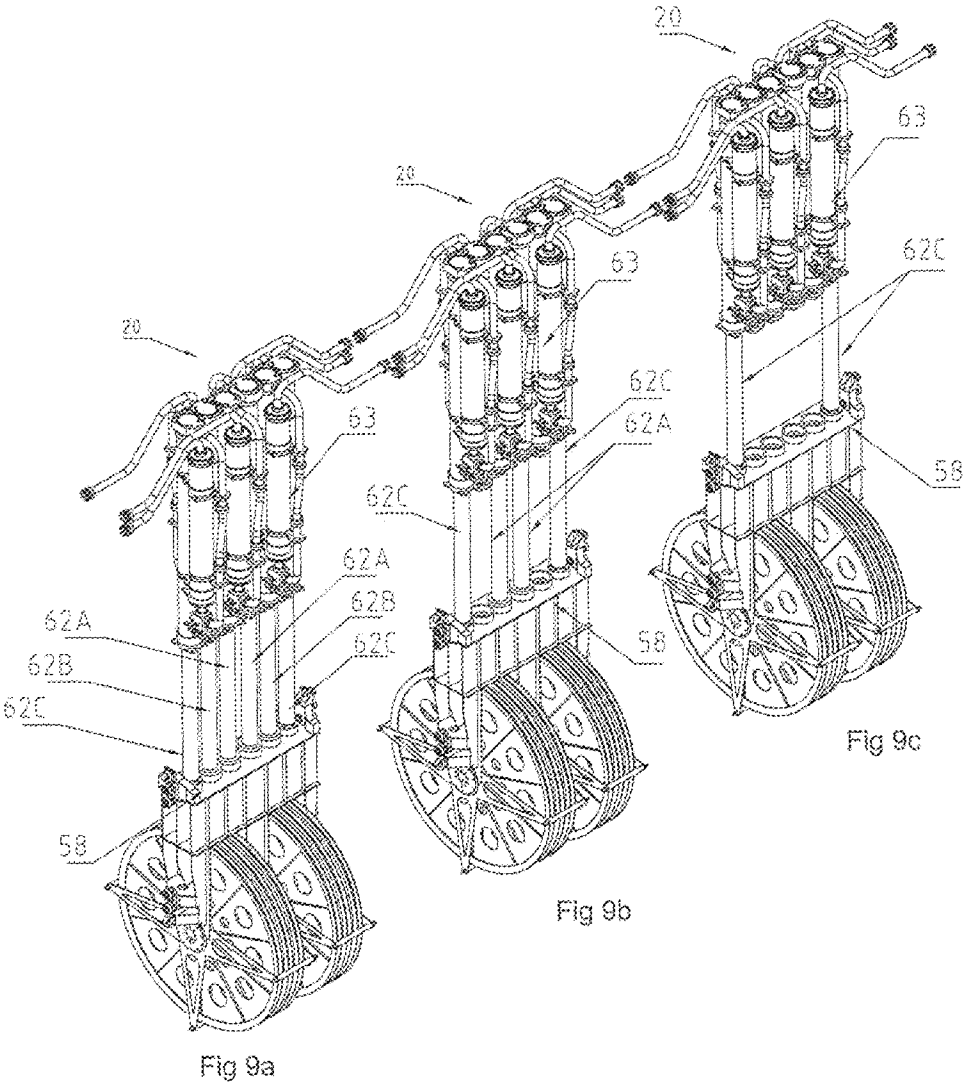

FIG. 9*a*-9*c* is an isometric view of the heave compensation system in FIG. 8*a*-8*c*.

Figure 10A:
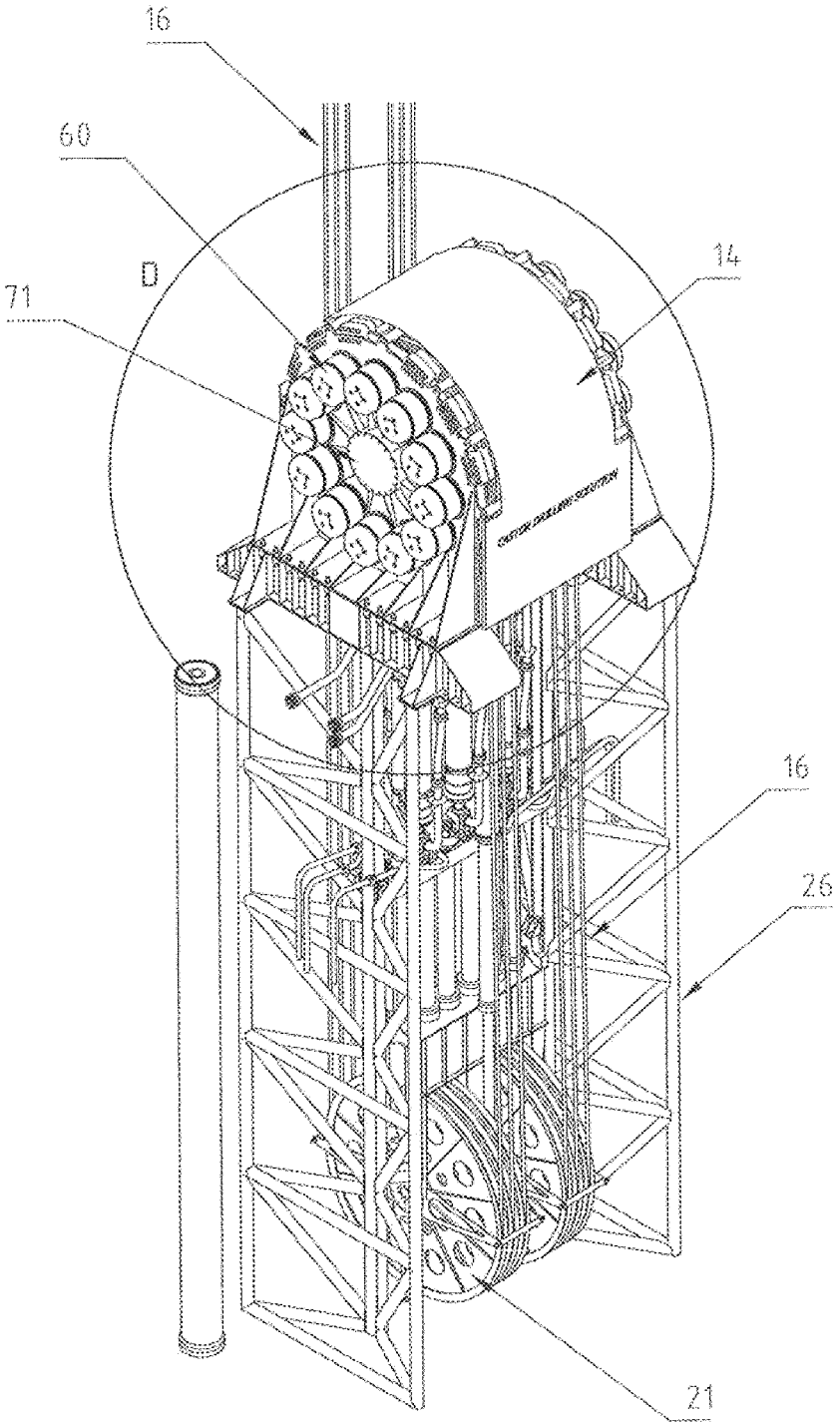
Figure 10B:
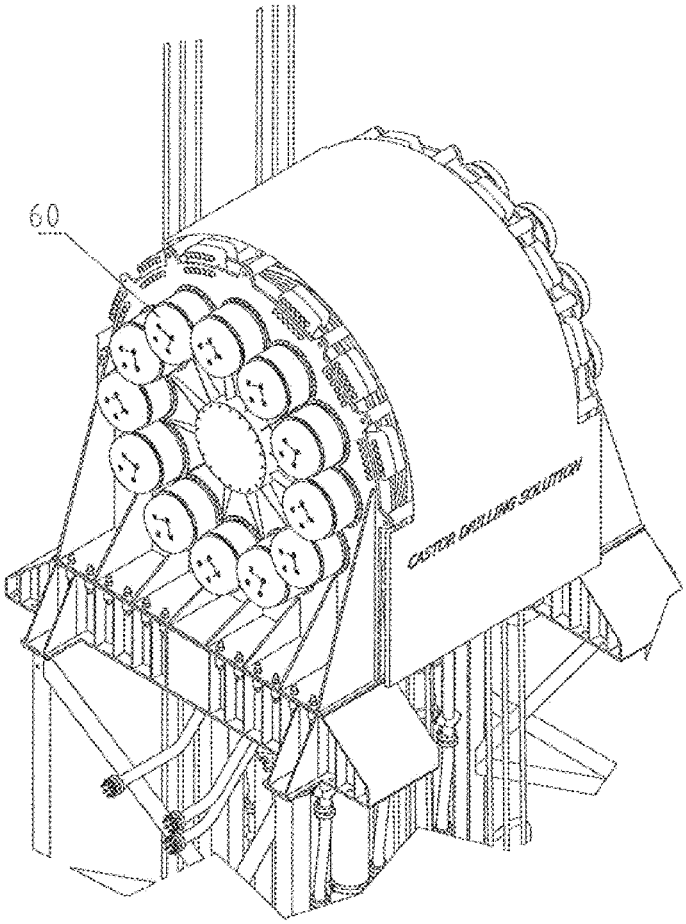

FIG. 10*a*-10*b* is an isometric view of passive compensator system attached to the winch system and a detail view of the winch system.

DETAILED DESCRIPTION

Figure 1:
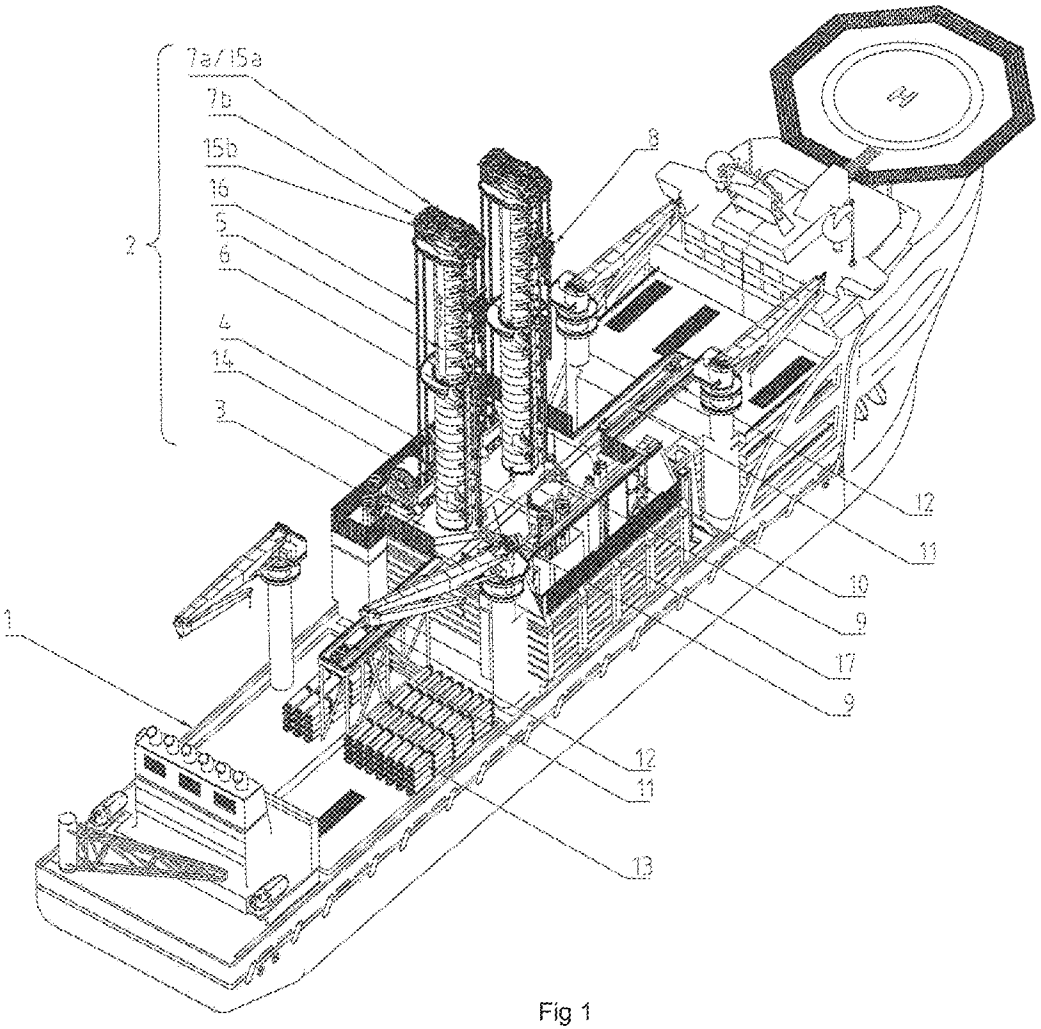
FIG. 1 shows a drilling rig arrangement according to the present invention with retractable drilling towers mounted on a drilling vessel.

FIG. 1 shows a drilling rig arrangement mounted on a drilling vessel 1. FIG. 1 shows two equal retractable drilling towers 2 connected to a rig floor 3 on the vessel 1. The drilling rig towers 2 are arranged next to one another on the vessel 1. The drilling rig towers 2 are shown in an elevated position in the figure and comprise a first, lower segment 4 and a second, upper segment 5. The second segment 5 is retractable within the first segment 4. A possible embodiment of the invention is a drilling rig tower 2 with more than two segments that comprises a base segment, one or more middle segments, and an upper segment. The middle and the upper segments are retractable. A well center 9 is arranged beside each of the towers 2. The towers 2 are mounted to the rig floor outside of the well center 9. A top drive 8 or a main block is arranged in a vertical line above the well center 9, suspended from at least one wire 16, and is adapted to be in operational connection with the well center 9. Pipes or riser segments 11 are arranged on pipe shouts 12 in a distance outside of the rig floor. The pipe segments are moved towards the well center 9. The top drives 8 are lifting the pipe segments 11 vertically and positioning the pipe segments 8 vertically above the well center 9 and into the well (not shown). The pipe segments 11 are also stored in a riser setback storage area 13 arranged below the rig floor 3. Drill pipe stands are located in the setback storage area 13 where the stands are transferred to the pipe shout 12 by a pipe handling equipment 18. The pipe shout 12 presents the stand to the topdrive 8. The topdrive 8 brings the stand to the well center 9.

A passive compensator 20 (shown in FIG. 2) and a winch system 14 are arranged at or near the rig floor level 3 beside each of the drilling rig tower 2. The winch system 14 with the passive compensator system 20 and the well center 9 are arranged on the opposite side of the drilling rig tower 2. On the top of the drilling rig tower 2, there is arranged at least one first sheave 7*a* and at least one second sheave 7*b*. The first sheave 7*a* is arranged at the side of the tower 2 facing the well center 9, the second sheave 7*b* is arranged at the side of the tower 2 facing the winch 14. The sheaves 7*a*, 7*b* are arranged with the center axis on shafts 15*a*, 15*b*. The shafts 7*a*, 7*b* are connected to the top of the tower 2 through a support arrangement 27 arranged on both ends of the shafts 15*a*, 15*b*. The shafts 15*a*, 15*b* are arranged substantially parallel. Preferably, there are arranged several first sheaves 7*a* on shaft 15*a* and several second sheaves 7*b* on shaft 15*b*, forming two clusters of sheaves at the top of the drilling tower 2. (This is seen in detail in FIG. 4*b*). A possible embodiment of the invention is to arrange one large sheave or one cluster of sheaves at the top of the drilling rig tower 2.

Figures 2, 3:
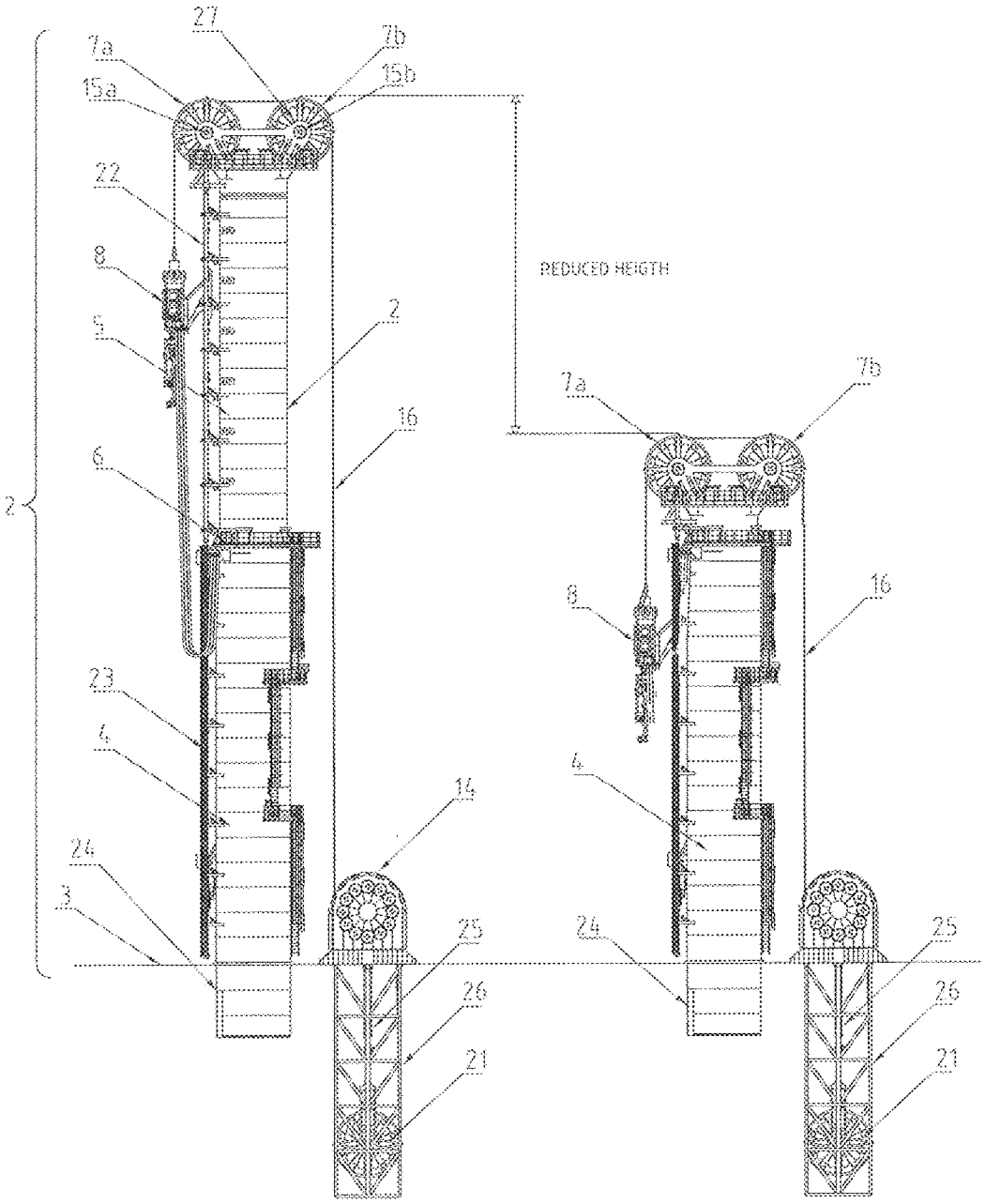
FIG. 2 shows the drilling tower arrangement schematically in an elevated position, viewed from the side.
FIG. 3 shows the drilling tower arrangement schematically in a retracted position, viewed from the side.

The top drive 8 is elevated and lowered into position using the winch system 14. The top drive 8 is in one end connected to wires 16. The wires 16 extend over the sheaves 7*a*, 7*b* on top of the second segment 5. The wires 16 extend further along the side of the drilling rig tower 2 facing the winch 14 and extend below the passive compensator 20 (FIG. 2) before the wires are connected to the winch 14 at the end of the wire 16. There could be arranged one wire 16 between the winch system 14 and the top drive 8, but preferably there are arranged several parallel wires 16, each wire extending over one first sheave 7*a* and one second sheave 7*b* at the top of the drilling rig tower 2, and one compensator sheave 21 (FIG. 2) at the bottom of the compensation arrangement 20. This is shown in detail in FIG. 2. FIG. 2 shows the drilling tower 2 arranged on the drilling vessel 1, but the arrangement could also be mounted on other drilling facilities suitable for the invention.

FIG. 2 shows the drilling rig arrangement schematically, the drilling rig arrangement is viewed from the side and the drilling tower 2 is in an elevated position. A socket 24 arranged at the lower part of the first segment 4 is bolted to a mounting in the rig floor 3. The second segment 5 and the first segment 4 are, in this position, connected to each other through a flange connection 6. This flange connection 6 is fixing the segments 4, 5 to each other when the drilling rig tower 2 is in the elevated position. This position is also the working position of the drilling rig. It is not possible to retract the tower before the flanged connection 6 between the first segment 4 and the second segment 5 are released.

The winch system 14 and the passive compensator system 20 are arranged on the opposite side of the top drive 8 as described in FIG. 1. The winch system 14 is attached to the drilling deck 3. The passive compensation system 20 is normally arranged at the underside of the winch system 14, but the system could also be arranged in the same horizontal plane as the winch system. Other arrangements relative to the winch system are also possible. The passive compensation system 20 is normally arranged below the drilling deck 3, but the compensation system could also be arranged above the rig floor, this being an embodiment of the invention. The passive compensation system 20 comprises a compensator sheave 21 or a cluster of parallel sheaves arranged on a shaft 28 and means for passive compensation 25. The passive compensation means 25 is arranged between the winch 14 and the compensator sheaves 21.

A frame structure 26 is arranged on two sides of the passive compensation system 20, the frame structure is extending from the underside of the winch system 14 and the drilling deck 3. The frame structures 26 provide support to the compensation system 20. In correspondence with the system there is also arranged an active compensation system 29 (shown in FIG. 6).

FIG. 3 shows the drilling rig arrangement schematically viewed from the side in a retracted position. This position is suitable for maintenance or transportation, but not as a working position for drilling the well. In this position the second segment 5 is disconnected from the flanged connection 6 and the second segment 5 is retractable within the first segment 4.

Figure 4A:
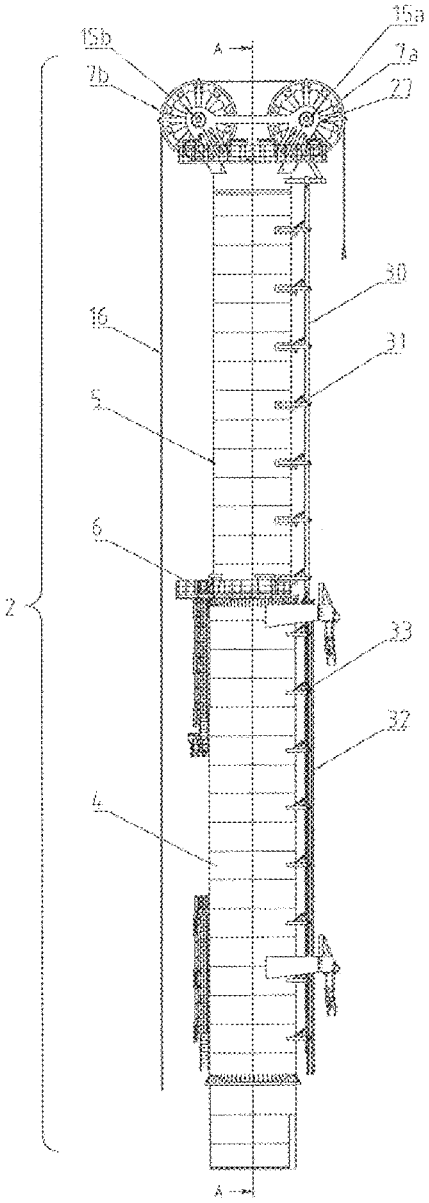
FIG. 4*a*-4*j* shows a possible means for raising and lowering the drilling rig tower in detail.
Figure 4B:
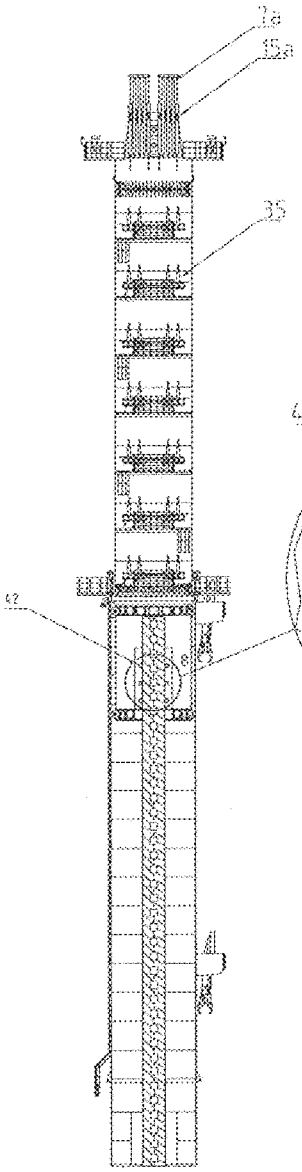
Figure 4C:
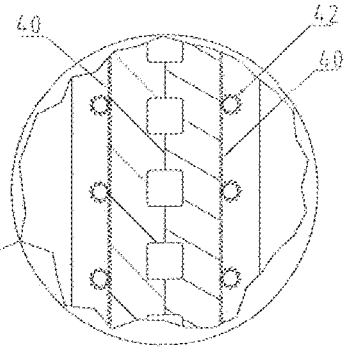
Figures 4D, 4E:
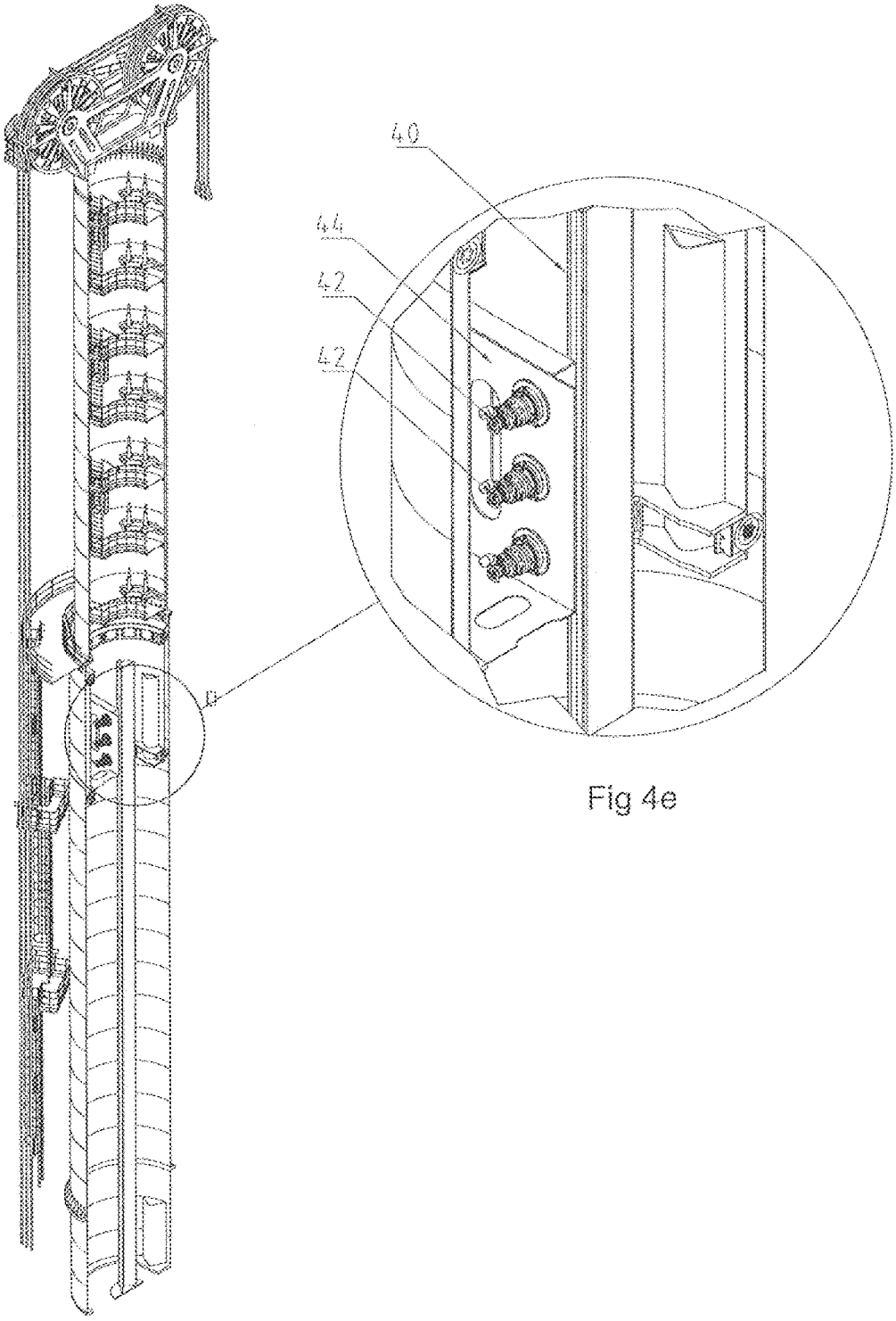
Figure 4I:
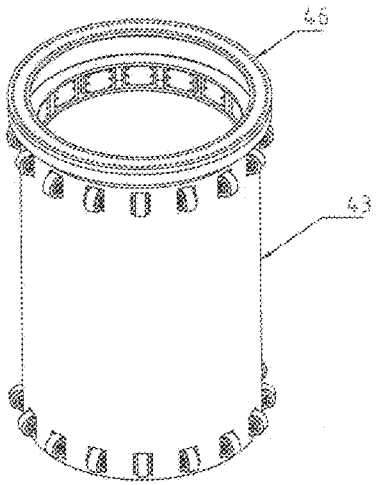
Figure 4H:
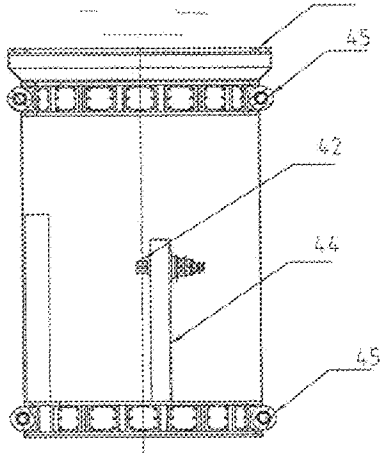
Figure 4F:
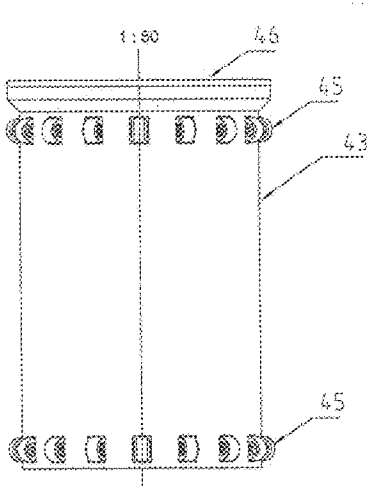
Figure 4G:
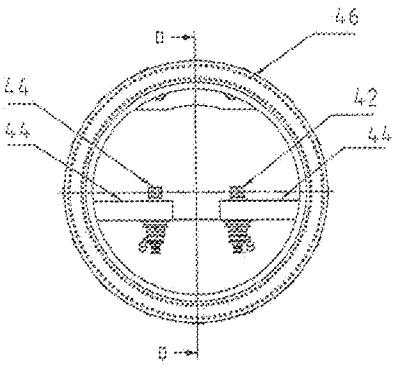
Figure 4J:
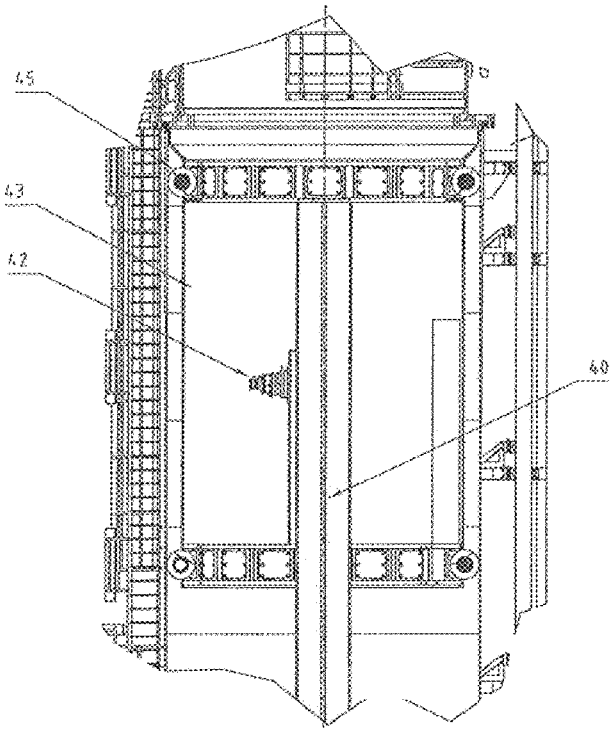

The following FIGS. 4*a*-4*f* show the raising and lowering mechanism of the drilling tower in detail. FIG. 4*a* shows the drilling tower 2 schematically, viewed from the side. FIG. 4*b* shows a cross section view of the drilling tower 2, seen from the line k-k in FIG. 4*a*. At the top of the second segment 5, the sheaves 7*a* are shown. The sheaves 7*a* are situated beside each other on the same shaft 15*a* as described earlier. The second sheave 7*b* are similar to sheaves 7*a*.

Means for raising and lowering of the retractable tower 39 are shown in FIGS. 4*b*-4*i*. A pitch rack 40 is arranged in the center of the first segment 4, extending from the rig floor 3 to or near the end of the first segment 4. The rack 40 includes teeth 41 that are adapted to engage circular gears 42. The gears 42 are arranged on both sides of the rack 40. The gears 42 are arranged on a vertical plate 44. The plate 44 is arranged on one side of the pitch rack 40 with several gears 42 arranged in pair. The pair of gears are situated on opposite sides of the pitch rack 40. The gears 42 are adapted engage with the teeth 41 of the pitch rack 40 and move the second segment 5 in the vertical direction. This is shown in detail in FIGS. 4*d*, 4*e*, 4*g* and 4*h*.

FIGS. 4*b*-4*e* show three pairs of gears 42 arranged on a vertical line on each side of the pitch rack 40, but this does not limit the invention. There could be arranged more than three or less than three pairs of gears 42 if that is suitable in relation to the present invention. There could also be more than one vertically aligned plate 44 arranged within the drilling rig tower 2.

The plate 44 is attached to an inner guide structure 43. The inner guide structure 43 is a cylindrical segment with a diameter slightly less than the lower segment 4. It has guide rollers 45 arranged around periphery of the inner guide structure 43 near both ends of the inner guide structure 43. The guide roller 45 rest against the inside of the lower segment 4 and are adapted to move in the vertical direction along the lower segment 4 by the gear 42 and pitch rack 40 arrangement. An upper part 46 of the inner guide structure 43 is connected to the bottom part of the upper segment 5 with bolts or similar connecting means so that the upper segment 5 moves the same distance in the vertical direction as the inner guide structure 43 is moved within the lower segment 4.

Other arrangements for raising or lowering the second segment 5 is also possible. Other typical possibilities for raising and lowering the tower segment are by use of a winch arrangement and/or by lowering the upper segment 5 into the lower segment column 4 with a large external crane.

FIGS. 4*a*-4*b* also show guiderails 30, 32 for guiding the second segments when it is retracted. The second segment 5 includes a pair of upper guiderails 30 attached to the outside of the second segment 5. At the first segment 4, a pair of lower guiderails or guide tubes 53 could also be attached to the outside of the first segment 4. The guidetubes 53 are oriented at the same side as the upper guiderails 30. In the Figure, the guiderails 30 and the guidetubes 53 are oriented at the side facing the top drive 8, but any orientation suitable for the invention are possible. The guiderails 30 and the guidetubes 53 are attached to the tower 2 through fastening means or brackets 31, 33. The upper brackets 31 are arranged at a suitable distance from each other along the upper guiderails 30, and the lower brackets 33 are arranged at a suitable distance from each other along the guidetubes 53.

At the inside of the second segment 5 there are arranged fixation devices 35. These fixation devices 35 corresponds to and are adapted to be connected to bracket segments 51 of the brackets 31. When the drilling rig tower 2 is in the elevated position, the fixation devices 35 are connected to the bracket segments 51. The fixation devices 35 are released from the bracket segments 51 before the lowering of the second segment 5 into the first segment 4 and the upper guiderails 30 could be moved a distance away from the upper segment 5 and a distance from the other guiderail 30. An opposite bracket segment 50 is connected to the guiderail 30. This is further described in FIGS. 5*a*-5*g*.

FIGS. 5*a*-5*d* shows the guide rails described in FIG. 4*a*-4*b* in detail. FIG. 5*a* shows the drilling tower 2 viewed from the front. There are two parallel guide rails 30 extending along the upper segment 5 and the two parallel guide rails 32 extending along the lower segment 4. FIG. 5*a* shows the position where the bracket segments 51 are released from the fixation devices 35 (FIG. 4*b*). The brackets 31 are in this position not connected in sleeve point the guide rails 30 could then move out and then away from each other and away from the second segment 5.

FIG. 5*b* shows a sectional view of the transition between the upper segment 5 and the lower segment 4. Guide pins 52 are attached to the brackets 31 and arranged between the pair of guiderails 30. The guide pins 52 are aligned vertically with guide tubes 53, which are attached to the lower guide rails 32. Each of the guide tubes 53 includes a longitudinal groove (not shown). The guide pins 52 are adapted to be guided down in the guide tubes 53 when the upper segment 5 of the tower 2 is retracted. There are also shown gripping means 56 for handling pipe segments 11.

FIG. 5*c* shows an isometric view of the upper guiderails 30 with brackets 31 and FIG. 5*d* shows a sectional view of one of the brackets 31. FIG. 5*g* shows the guiderails from FIG. 5*c*, viewed from the front and from the side.

FIG. 5*e* shows a sectional view of the fixation devices 35 at the inside of the upper guide rail 30 and FIG. 5*f* shows a cross view of the fixation devices at the line H-H. The fixation device 35 is locking the bracket segment 51 with an internal bolt 54 that passes through an opening 55 in the bracket segments 51.

FIGS. 5*h* and 5*i* shows isometric views of the first segment 4 with the guide tubes 53 shown in detail.

FIG. 6 shows the drilling rig arrangement schematically, viewed from the side. FIG. 6 shows a detailed overview of the winch system 14, the passive compensation system 20, and an active compensation system 29 according to the present invention. The systems 14, 20, and 29 are not arranged in actual position related to each other or the drilling tower 2 in FIG. 6.

The winch system 14 comprises a plurality of winch motors 60 connected to a hydraulic power system 61 and accumulators 72. The hydraulic winch motors 60 are digital and utilize a multiple digital hydraulic motors 60 providing excellent resolution and optimized power consumption. This provides accurate positions to the load to be lifted or lowered by the winch system 14. When there is a heavy load on the hook or top drive 8, most of the hydraulic motors 60 or motor segments are online and the motor power required to the winch 14 is high. In the other case when there is no load on the top drive 8 or hook only a few of the hydraulic motors or motor segments 60 are online, and most of the motors or motor segments 60 are idling. The hydraulic power from the power unit 61 that is not needed in the system could then be led to the accumulator 72 until it's needed again for heavy loads or high speed operation of the winch 14. This system enables to equalize the power need from the generator during a sequence of the tripping inn/lifting operation to give a more optimized generator performance for a typical sequenced drilling operation. That again gives less peak power needed from the generator sets and by this also improves the overall greenhouse gas emissions for this operation. During lowering of a load the returned power from the winch motors 60 are directly transferred back to the accumulator 72 from the braking energy. This energy can be for use during the next lifting operation or for equalizing the power regeneration back to the ship/rig system during a long trip inn/lowering sequence where there is a lot of fluctuating excess power generated back to the ship/rig power management system. The accumulators 72 are operatively coupled to the winch system 14 to boost and store the hydraulic flow and pressure when high power is needed or generated back from the system. The stored energy in the accumulators 72 can also be used for emergency lift off operation with the winch system 14 during a black ship scenario. The winch motors 60 could also be of other types than hydraulic for instance electrical motors as a direct drive system or in combination with an electrical power storage and management system.

The passive compensation system 20 is connected to the winch system 14 and comprises a cylinder 62 and a cylinder housing 63 which are connected to an oil/gas separator 64 and pressure vessels 65 for compensating the cylinder 62 position relative the movement of the drilling vessel 1 in order to maintain the position of the top drive 8 in a steady position. The wires 16 are extending from the top drive 8 and runs over the upper sheave cluster. The wires 16 further extend to the compensator sheave cluster 21 and runs via the compensator sheave cluster to the winch 14. This gives a 2:1 exchange on the compensator cylinder movement.

This system achieves a combined unit for hoisting winch and active and autonomous passive compensation. The winch system 14 comprises several digital drives that allows optimal transmission of power and possibility for passive and active wave compensation.

FIG. 7*a* shows the winch and compensation system in detail, viewed from the side. FIG. 7*b* shows the winch and compensation arrangement seen in FIG. 4, viewed from the behind. There are several compensator sheaves 21 arranged beside each other and also several wires 16 arranged beside each other extending round parts of the periphery of the compensator sheaves 21. There are arranged six passive cylinders 62*a*, 62*b*, 62*c* between the winch 14 and the compensator sheaves 21.

FIGS. 8*a*, 8*b* and 8*c* shows different configuration of the passive compensation arrangement. 20. In FIG. 8*a*, all of the six cylinders 62*a*, 62*b*, 62*c* are online and compensating the load. In this position, the maximum compensator capacity is obtained. This system is often used in loads in a range between 655-1000 short tons, but is not limited to that range.

In FIG. 8*b*, there are four cylinders 62*a*, 62*c* online. The last two cylinders 62*b* are released from a compensator sheave holder 66 arranged between the compensator sheaves 21 and the cylinders 62*a*, 62*b*, 62*c* into the cylinder housing 63 and will not give any compensation to the system in this position. This position is most suitably for loads in a range between 335-655 short tons, but the loads are not limited to this range.

In FIG. 8*c*, there are only two cylinders 62*c* online and the other four cylinders 62*a*, 62*b* are retracted into a corresponding cylinder housing 63. This position provides the minimum compensator capacity and is suitable for small loads, typically between 0-35 short tons, but not limited to this range. The cylinders 62*c* on the outside are normally connected to a compensator sheave frame 58 arranged between the compensator sheaves 21 and the cylinder 62*c*, the cylinders 62*c* could also be released from the compensator sheave frame 58 like the other cylinders 62*b*, 62*a*.

The cylinders 62*a*, 62*b*, 62*c* are adapted to abut or be connected to the compensator sheave frame 58 when they are online. If one of the pair of cylinders is broken, the other pair of cylinders could be set online instead. The variable number of heave cylinders 62*a*, 62*b*, 62*c* ensures optimal heave compensation characteristics/performance at any drilling or downhole operation, eliminating unnecessary dead weight and friction losses. The cylinders 62*a*, 62*b*, 62*c* operate in pair to balance the compensation arrangement 21.

FIGS. 9*a*, 9*b* and 9*c* shows an isometric view of the passive compensation system from 8*a*, 8*b* and 8*c*.

FIGS. 10*a* and 10*b* shows an isometric view of the winch system and passive compensation system as shown in FIGS. 7*a* and 7*b*.

The winch system comprises a plurality of hydraulic motors 60, which are adapted to engage with a common winch drum 71. The plurality of hydraulic motors 60 are engaged in a circle at one end of the winch drum 71. A circle of hydraulic motors 60 are arranged at each end of the winch drum 71. The number of motors online depends on the load on hook or top drive 8. When, for instance, an empty top drive 8 or hook is lowered a few of the motors are online, the rest of the motors are idling. In the opposite case, when the top drive 8 or hook are hoisted with weight on the hook, a few of the motors are idling and the rest of the motors are online.

The invention claimed is:

1. A system for operating a drilling rig on a drilling vessel, the system comprising:

a heave compensation arrangement adapted to passively compensate a drilling tool, said drilling tool being suspended from at least one wire rope, said at least one wire rope over at least one sheave on top of a drilling tower;

at least one compensation sheave carried by a compensator frame of the compensation arrangement, said at least one wire rope extending over said compensator sheave and coupled to a winch, wherein said compensator arrangement is operatively arranged between the at least one sheave on top of the drilling tower and said winch; and a plurality of compensator cylinders arranged between said winch and said compensation sheave, the plurality of compensator cylinders adapted to compensate different loads, and at least one of the plurality of compensator cylinders is releasably attachable to said compensator sheave frame.

2. The system according to claim 1, wherein said drilling tower comprises at least two segments, the at least two segments comprising a first segment fixedly connected to said drilling vessel and a second segment connected to the first segment, said second segment being adapted to move longitudinally relative to the first segment by raising and lowering means.

3. The system according to claim 1, further comprising a drilling floor arranged on an outside of the drilling tower and said drilling tool is vertically aligned above a well center.

4. The system according to claim 1, wherein the compensation arrangement comprises an outer pair of cylinders that are fixedly connected between the at least one compensator sheave and the winch, an inner pair of cylinders, and a middle pair of cylinders that are in releasable connection with the at least one compensator sheave, said outer pair of cylinders are arranged on the outside of the middle pair of cylinders and the inner pair of cylinders.

5. The system according to claim 1, wherein the winch comprises a digital hydraulic motor.

6. The system according to claim 2, wherein the raising and lowering means comprise a pitch rack arranged within the first segment, said pitch rack having teeth adapted to engage circular gears, said circular gears arranged on an inner guide structure, said inner guide structure arranged within the first segment and fixedly connected to a bottom of the second segment, said guide structure adapted to move along an inner surface of the first segment.

7. The system according to claim 2, wherein the at least two segments are modular, cylindrical segments.

8. The system according to claim 2, wherein the first segment and second segment are bolted together in an elevated position of the drilling rig.

9. The system according to claim 2, wherein at least one upper guiderail is releasably connected to the second segment.

10. The system according to claim 2, further comprising a third segment arranged between the first segment and second segment.

11. The system according to claim 4, wherein said inner and middle pair of cylinders are adapted to retract within the cylinder housing, the plurality of cylinders are arranged parallel to each other, and said cylinders are operable in pairs.

12. The system according to claim 4, wherein said inner and middle pair of cylinders are situated between said outer pair of cylinders, said outer pair of cylinders are coupled to the compensator sheave frame.

13. The system according to claim 1, wherein the passive compensator arrangement are arranged below the winch and below a drill floor.

* * * * *